US010799873B2

(12) United States Patent
Yunger et al.

(10) Patent No.: US 10,799,873 B2
(45) Date of Patent: Oct. 13, 2020

(54) NAUTILOID SHAPED FAN HOUSING FOR A COMMINUTION MILL

(71) Applicant: Energy Creates Energy LLC, Kansas City, MO (US)

(72) Inventors: John Casey Yunger, Shawnee, KS (US); Phil Goldsby, Lenexa, KS (US); Kyle Tucker Watts, Lee's Summit, MO (US)

(73) Assignee: Energy Creates Energy LLC, Kansas City, MO (US)

( * ) Notice: Subject to any disclaimer, the term of this patent is extended or adjusted under 35 U.S.C. 154(b) by 448 days.

(21) Appl. No.: 15/550,271

(22) PCT Filed: Feb. 12, 2016

(86) PCT No.: PCT/US2016/017764
§ 371 (c)(1),
(2) Date: Aug. 10, 2017

(87) PCT Pub. No.: WO2016/130924
PCT Pub. Date: Aug. 18, 2016

(65) Prior Publication Data

US 2018/0015478 A1 Jan. 18, 2018

Related U.S. Application Data

(60) Provisional application No. 62/115,234, filed on Feb. 12, 2015.

(51) Int. Cl.
*B02C 13/00* (2006.01)
*B02C 13/18* (2006.01)
(Continued)

(52) U.S. Cl.
CPC ..... *B02C 13/1814* (2013.01); *B02C 7/02* (2013.01); *B02C 13/09* (2013.01); *B02C 13/282* (2013.01);
(Continued)

(58) Field of Classification Search
CPC . B02C 13/1814; B02C 13/288; B02C 13/282; B02C 13/18; B02C 7/02; B02C 23/30; B02C 23/34
(Continued)

(56) References Cited

U.S. PATENT DOCUMENTS 2,609,995 A 9/1952 Klagsbrunn
2,762,572 A 9/1956 Lykken et al.
(Continued)

OTHER PUBLICATIONS

International Search Report and Written Opinion in corresponding PCT Serial No. PCT/US2016/017764, dated Jun. 3, 2016 (14 pages).

*Primary Examiner* — Faye Francis
(74) *Attorney, Agent, or Firm* — Hovey Williams LLP

(57) ABSTRACT

A mill includes a generally vertical, rotatable shaft having at least one set of cutter blades driven thereby and a fan assembly mounted on the shaft below the cutter blades in position to receive output therefrom. The fan assembly includes a fan disc secured to the shaft and rotatable therewith. A plurality of fan blades is secured to the fan disc in a generally radial orientation. A terminal portion of the mill includes a gradually, radially expanding outer wall configured in a volute form. The expanded outer wall decreases wear and increases efficiency of discharge and airflow through the mill.

18 Claims, 13 Drawing Sheets

(51) Int. Cl.

| | |
|---|---|
| ***B02C 13/282*** | (2006.01) |
| ***B02C 13/288*** | (2006.01) |
| ***B02C 13/09*** | (2006.01) |
| ***B02C 7/02*** | (2006.01) |
| ***B02C 18/12*** | (2006.01) |
| ***B02C 23/30*** | (2006.01) |

(52) U.S. Cl.
CPC ..... *B02C 13/288* (2013.01); *B02C 18/12* (2013.01); *B02C 23/30* (2013.01); *B02C 2201/06* (2013.01)

(58) Field of Classification Search
USPC ..... 241/56
See application file for complete search history.

(56) References Cited

U.S. PATENT DOCUMENTS 3,260,468 A 7/1966 Beard
3,640,475 A 2/1972 Jung et al.
4,151,794 A * 5/1979 Burkett ..... B02C 13/286 100/215
5,192,029 A * 3/1993 Harris ..... B02C 13/14 241/154
5,205,500 A * 4/1993 Eide ..... B02C 13/18 241/154
7,950,601 B2 * 5/2011 Watts ..... B02C 13/1814 241/55
8,267,337 B2 * 9/2012 Webb ..... B02C 13/18 241/27
8,662,429 B2 * 3/2014 Matlin ..... B02C 18/0007 241/100
9,707,564 B2 * 7/2017 Mogan ..... B02C 13/18
9,751,087 B2 * 9/2017 Watts ..... B02C 13/288
2009/0194624 A1 * 8/2009 Knueven ..... B02C 13/1807 241/275
2010/0327096 A1 * 12/2010 Watts ..... B02C 13/1814 241/56
2011/0215179 A1 * 9/2011 Watts ..... B02C 13/1814 241/56
2012/0119003 A1 * 5/2012 Watts ..... B02C 13/09 241/30
2013/0043336 A1 * 2/2013 Watts ..... B02C 13/1814 241/55
2016/0045919 A1 * 2/2016 McDaniel ..... B02C 13/18 241/191

* cited by examiner

NAUTILOID SHAPED FAN HOUSING FOR A COMMINUTION MILL

CROSS-REFERENCE TO RELATED APPLICATIONS

The present application is the National Stage of International Patent Application No. PCT/US2016/017764, filed Feb. 12, 2016, which claims the priority benefit of U.S. Provisional Patent Application Ser. No. 62/115,234, filed Feb. 12, 2015, entitled NAUTILOID SHAPED FAN HOUSING FOR A COMMINUTION MILL, each of which is incorporated by reference in its entirety herein.

BACKGROUND

Field of the Invention

The present invention relates to grinders, mills, shredders, or like equipment used to convert a material from an unprocessed state to a processed state having a reduced particle size and a reduced moisture content.

Description of Related Art

Grinders, shredders, or mills are well known devices for reducing the particle size of a material. For example, U.S. Pat. No. 5,192,029 to Harris and U.S. Pat. No. 5,680,994 to Eide et al. each disclose mills for grinding garbage. Each of these mills includes a rotor rotatably mounted in a generally octagonal housing. The rotor includes a generally vertical shaft and a plurality of blades or hammers mounted on the shaft. Garbage is admitted into the housing through an inlet near the top of the housing and is impacted by the blades of the rotor. Material of a reduced particle size is removed from the mill through an outlet near the bottom of the housing. The ground garbage can be sent to a landfill where it will take up less room than unprocessed garbage, or it can be composted or recycled, depending on the included materials. If the material is to be shipped, it can be shipped more efficiently due to its reduced size and greater density.

The mill of Eide et al. '994 further includes a fan or impeller that is mounted on the rotor shaft below the cutting blades. The fan is intended to create airflow that acts to move material through the mill and to expel it from the outlet. The fan generally comprises a fan disc mounted to the rotor shaft, which has a plurality of radially extending lengths of angle iron mounted thereon. One flange of each angle iron is bolted to the fan disc and the other extends upwardly from the disc to act as a fan blade. The angle irons are fixedly mounted to the fan disc and no means are provided for adjusting the airflow for different materials or grinding conditions.

U.S. Pat. Nos. 7,950,601, 8,308,090, and 8,678,306 and U.S. Patent Application Publication Nos. 2014/0077011, 2014/0154080, 2012/0119003, and 2014/0077009, all to Watts, also describe vertical comminution mills or grinders that improve on mills known in the art.

SUMMARY

An issue that remains in known mill configurations is wearing of the interior walls of the mill. In mills with a faceted interior surface, e.g. an octagonal interior surface comprised of adjacent plates, the ground materials tend to follow along each facet or plate in a generally linear fashion and contact the next adjacent plate at or near the junction between the plates due to their differences in orientation. The impact of the ground materials against the adjacent plates erodes the plates and eventually leads to need for replacement thereof. There remains a need for a mill configuration that reduces or eliminates wearing of the interior walls of the mill.

Another issue is the removal of moisture before and/or after size reduction has taken place. There remains a need to be able to have control over the amount of air that is passing through the system in relation to relative humidity of the air and moisture content.

An additional issue is airflow as it relates to residence time of the material in the equipment. The desired residence time is related to moisture content, as it can affect the degree of liberation of materials from each other and will affect particle size reduction. There remains a need for residence time control.

A high-level overview of various aspects of the invention is provided here to introduce a selection of concepts that are further described in the Detailed Description below. This summary is not intended to identify key features or essential features of the claimed subject matter, nor is it intended to be used in isolation to determine the scope of the claimed subject matter. In brief, this disclosure describes, among other things, a comminution mill or grinder of the general type disclosed above and including an improved discharge configuration. The mill includes a fan assembly with fan blades that generate airflow through the mill to aid the flow of materials through the system. A discharge portion of the mill is configured with an outer wall of increasing radial distance from an axis of the mill in a volute or nautiloid (scroll) form. This configuration enables ground materials to move radially outward and away from the fan blades while continuing along a circumferential path about the mill toward an outlet chute. The force and wear of impacts between the ground materials and the outer wall is thus reduced thereby increasing the lifespan of the outer wall.

More particularly, a mill for grinding material is described, which comprises a housing comprising a top wall and an inlet for admitting material into the mill; a generally vertical, rotatable shaft having a least one cutter disc driven thereby, which is mounted inside the housing; and a fan assembly integrally mounted inside the housing and spaced below the at least one cutter disc. The fan assembly comprises a fan disc having an outer edge, a direction of rotation, and a plurality of fan blades mounted on top of the fan disc, each fan blade comprising an upwardly extending web. Advantageously, the fan assembly also includes a fan housing comprising a radially expanding outer wall and a discharge outlet for discharging material from the mill. The outer wall is configured with an increasing radius of curvature as measured from the center of the fan disc in the direction of rotation towards the discharge outlet, such that the outer wall defines a radially expanding, spiral-shaped flowpath as measured between the outer edge of the fan disc and the outer wall. Advantageously, the flowpath is configured for conducting material to the discharge outlet.

Methods of grinding material from an initial size to a reduced particle size are also described herein. The methods generally comprise providing a mill according to any one of the embodiments described herein and introducing a material having an initial size and moisture content into the inlet of the mill. The material is processed in the mill by rotating the cutter disc(s) and fan disc, whereby the material is reduced from its initial size to a reduced particle size. The material undergoes dynamic forces, including but not limited to, impact, shear, torsion, centrifugal, air resistance, gravity, tension, pressure, friction, and comminution. It is this dynamic force that that reduces particle size, liberates material with different physical properties from each other including liquids from non-liquids. The resulting material of a reduced particle size is then collected from the discharge outlet. Exemplary materials for processing in the mill include those comprises rigid and non-rigid components, so as to separate the rigid and non-rigid components (i.e., "demanufacture" the material) and also reduce their particle size. Advantageously, the fan assembly draws air into the inlet of the mill and efficiently expels air and the material of reduced particle size and reduced moisture content out of the discharge outlet during operation.

DESCRIPTION OF THE DRAWINGS

Illustrative embodiments of the invention are described in detail below with reference to the attached drawing figures, and wherein.

DETAILED DESCRIPTION OF PREFERRED EMBODIMENTS

Figure 1:
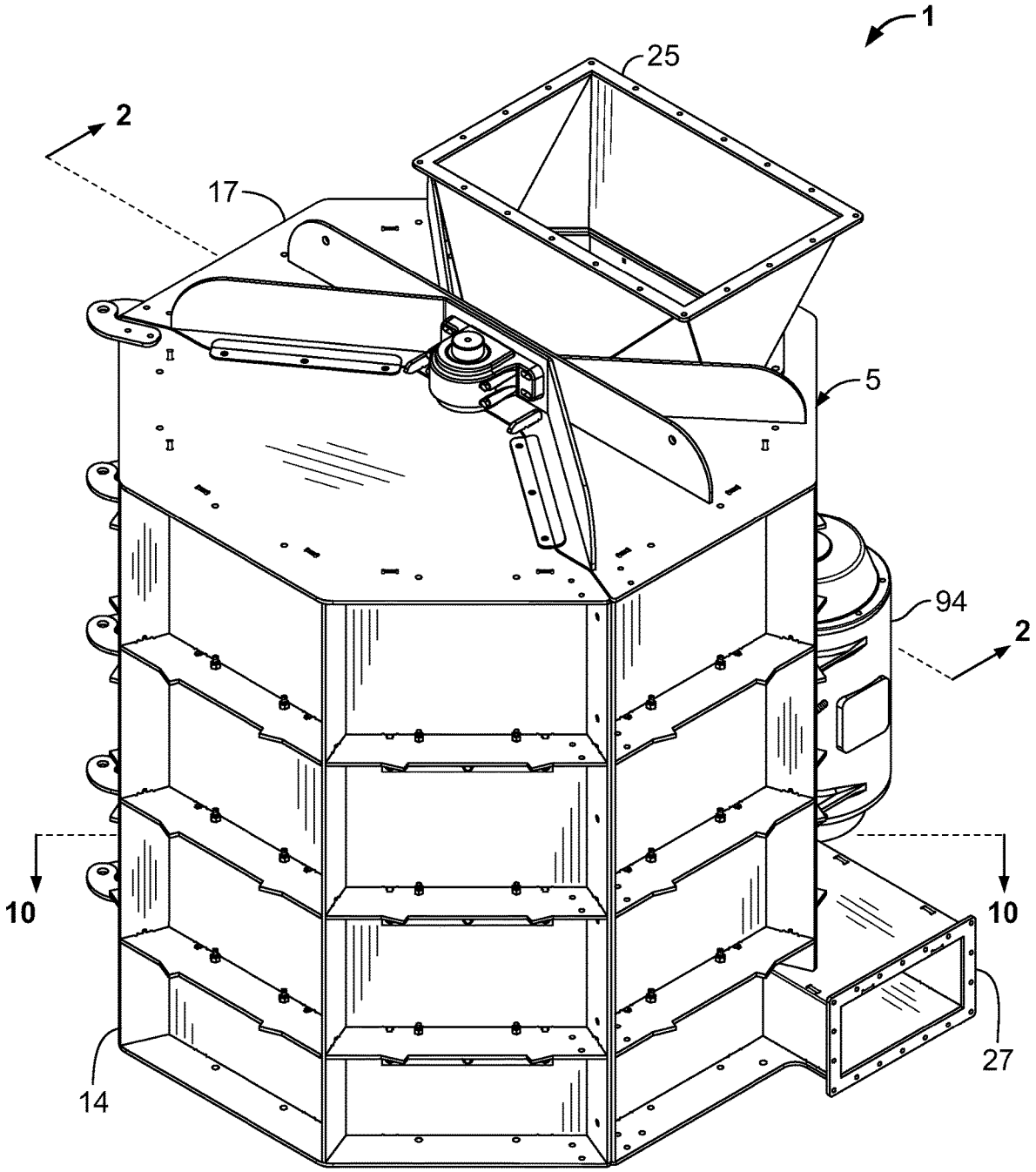
FIG. 1 is a perspective view of a comminution mill according to an embodiment of the present invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import. The terms "about" or "approximately" as used herein denote deviations from the exact value by +/−10%, preferably by +/−5% and/or deviations in the form of changes that are insignificant to the function.

Referring to the drawings in more detail, reference number 1 generally designates a mill according to the present invention. As described herein, the mill 1 can be configured for use in a variety of material breakdown operations including, for example, comminuting, grinding, shredding, and cutting operations. The mill 1 is also configurable for use in material mixing, blending, and dewatering operations, among others; all such operations are referred to generally herein as grinding. The materials to be ground may include items such as: carpet, tires, shoes, hydraulic hose, gypsum board, and other products to be de-manufactured or broken down into their component pieces; asphalt roofing materials, plastics, composite boards, brake pads, and other materials that can be reprocessed into new products; tires, plastics, shingles, paper goods, textiles, aluminum, and other wastes for recycling; biomass, agricultural waste, municipal solid waste, construction waste, military waste, landfill waste, and other materials that are useable for production of energy; electronics wastes like circuit boards, monitors, computers, cell phones, and the like; cotton and other textiles for reconstitution; and industrial manufactured scrap like pre-consumer waste, asphalt shingle by-products, quality control rejects, and the like. The mill 1 may also be employed to aid biomass-to-energy conversion processes by aiding gasification, anaerobic digestion, incineration, plasma, and co-firing processes. Mixing operations including, for example, mixing of tires or biomass with coal or mixing refuse derived fuels with biomass as well as densification processes for pre-pelletizing and transporting of materials can also be completed using the mill 1.

The mill 1 includes a rotor 3 rotatably mounted in a housing 5. The rotor 3 includes a generally vertical shaft 7 and a plurality of cutter discs 9 longitudinally mounted on the shaft 7 and extending radially outward therefrom. In one or more embodiments, the cutter discs have a substantially circular shape/annular circumference. A fan disc 10 is connected to the shaft 7 below the lowermost of the cutter discs 9 and spaced downwardly therefrom. In one or more embodiments, the fan disc is a substantially circular shape/annular circumference. The drawings show three cutter discs 9 denominated as discs 9*a*, 9*b*, and 9*c* from top to bottom, with the fan disc 10 spaced downwardly from cutter disc 9*c*.

Each cutter disc 9 comprises a top surface, an opposing bottom surface, and an outer edge. Each cutter disc 9 comprises a plurality of cutter blades or hammers 11 connected thereto that extend radially outward past the outer edge of the respective cutter disc 9. Four hammers 11 arranged at 90-degree intervals are shown for each of the cutter discs 9. The hammers 11 are each shown as being rigidly connected to the top surface of the respective cutter disc 9 by a pair of bolts 13. It is foreseen, however, that each hammer 11 could be fastened by only a single bolt 13 so as to pivot or swing about the bolt 13 relative to the respective cutter disc 9. It is also foreseen that each hammer 11 could be fastened by a single bolt 13 or plurality of bolts 13 to an intermediate bracket (not shown), and the bracket could therefore be fastened by a single bolt 13 or plurality of bolts 13 to the respective cutter disc 9.

In one embodiment, the mill 1 includes at least one baffle and preferably, a pair of baffles (not shown) fixedly mounted in the mill 1 in the space above the first or upper cutter disc 9*a* and below the top wall 17, as depicted in U.S. 2012/0119003 (referred to therein as "a pair of deflectors"), filed Oct. 24, 2011, incorporated by reference herein in its entirety. Each baffle is generally planar and may be formed from sheet metal, rubber, or similar flexible or rigid material and extends along a radius of the housing chamber, from the housing sidewall 14 towards the rotor shaft 7 with a relatively small gap formed between each baffle and the shaft 7. The gap is preferably relatively small (e.g., about an inch or less, preferably less than one quarter inch). The baffles each comprise a main vertically planar body or main portion that extends downward from the top wall 17 toward the upper cutter disc 9*a*. The main body spans roughly half the distance between the top wall 17 and upper cutter disc 9*a*. A baffle leg extends from the baffle main body on the side or end proximate the rotor shaft 7 and extends closer to the upper cutter disc 9*a* than the main body of the deflector. A lower edge of the main body and an outer edge of the leg define a gap or channel through which material to be ground can pass. The size of the gap can be varied depending on the physical properties of the material to be ground.

In another embodiment, the mill 1 may also include a cylinder or cylindrical housing (not shown) encasing at least a portion of the length of the center shaft 7, as depicted in U.S. 2012/0119003, filed Oct. 24, 2011, incorporated by reference herein in its entirety. The cylindrical housing can be positioned around the shaft 7 above the top cutter disc 9*a*, and for example, can rest on top of the top cutter disc 9*a*. The cylindrical housing can vary in circumferential dimension relative to the length of raw material being processed. The circumference of the cylindrical housing is preferably greater than the length of the longest non-rigid material feedstock (e.g., longer than the longest fibers of the material to be processed). The cylindrical housing functions to prevent or resist wrapping of string or strands around the rotor shaft 7. Once the strings or strands move past the first cutter disc 9*a*, the hammers 11 chop or grind most of the strands to a length short enough that the strands do not wrap around the shaft 7.

The housing 5 is generally octagonal in shape and includes a sidewall 14 comprising eight sidewall sections 15, a top wall 17 and a bottom wall 19, which enclose a grinding chamber (in which the shaft 7, cutter discs 9, and fan disc 10 are housed). The housing 5 includes a door 21, comprising three of the sidewall sections 15, which is hingedly connected to a main housing 23 which comprises the remaining five sidewall sections 15. The top and bottom walls 17 and 19 are each divided into respective first sections 17*a* and 19*a* that form part of the main housing 23 and respective second sections 17*b* and 19*b* that form part of the door 21. The line of division between the first sections 17*a* and 19*a* and the second sections 17*b* and 19*b* preferably extends through the axis of rotation of the shaft 7 such that the rotor 3 may be easily installed or removed through the opening provided by swinging open the door 21. An entrance chute/inlet 25 for admitting material into the mill 1 is formed on the top wall 17 and communicates with the interior/grinding chamber of the housing 5 through an opening in the top wall 17. In one or more embodiments, the top wall 17 is removable from the housing 5 and can be rotated as needed to position the inlet 25 in the desired location for ease of access. A discharge chute 27 for discharging material from the mill 1 is formed through the sidewall 14 and communicates with the interior of the housing 5 through an opening formed in the sidewall 14. The discharge chute 27 opening is positioned such that the bottom edge of the opening is below the plane of the underside of the fan disc 10 (and preferably, the bottom edge of the opening can be substantially planarly aligned with the plane of the bottom wall 19 of the housing 5). Likewise, the discharge chute 27 opening is positioned such that the top edge of the discharge chute 27 opening is above the top of the fan blades 85, but below the bottom edge of the lowermost cutter disc 9. Thus, the height of the discharge chute 27 opening as measured from its bottom edge to its top edge, extends from a plane below the fan disc (and preferably planarly aligned with the bottom wall 19) to a plane aligned with the bottom edge of the lowermost cutter disc 9 in the mill 1, but in any event at least extends to a plane aligned with the top of the fan blades 85.

In one or more embodiments, it may be desirable to heat and/or cool the mill housing 5 during operation of the machine. It will be appreciated that this can be accomplished by directly heating and/or cooling the sidewalls. It can also be accomplished by heating and/or cooling the air drawn into the mill during operation.

The shaft 7 of the rotor 3 is rotatably journaled to the main housing section 23 by upper and lower bearings 29 and 31 respectively. The upper bearing 29 is mounted in a pillow block 32 located immediately above the top wall 17 and connected to an upper framework 33 that is fixed to the top wall 17. Similarly, the lower bearing 31 is mounted in a pillow block 34 located immediately below the bottom wall 19 and connected to a lower framework 35 that is fixed to the bottom wall 19. The weight the shaft 7 of the rotor 3 could be axially supported either by upper bearing 29 or lower bearing 31 or combination thereof.

Figure 3:
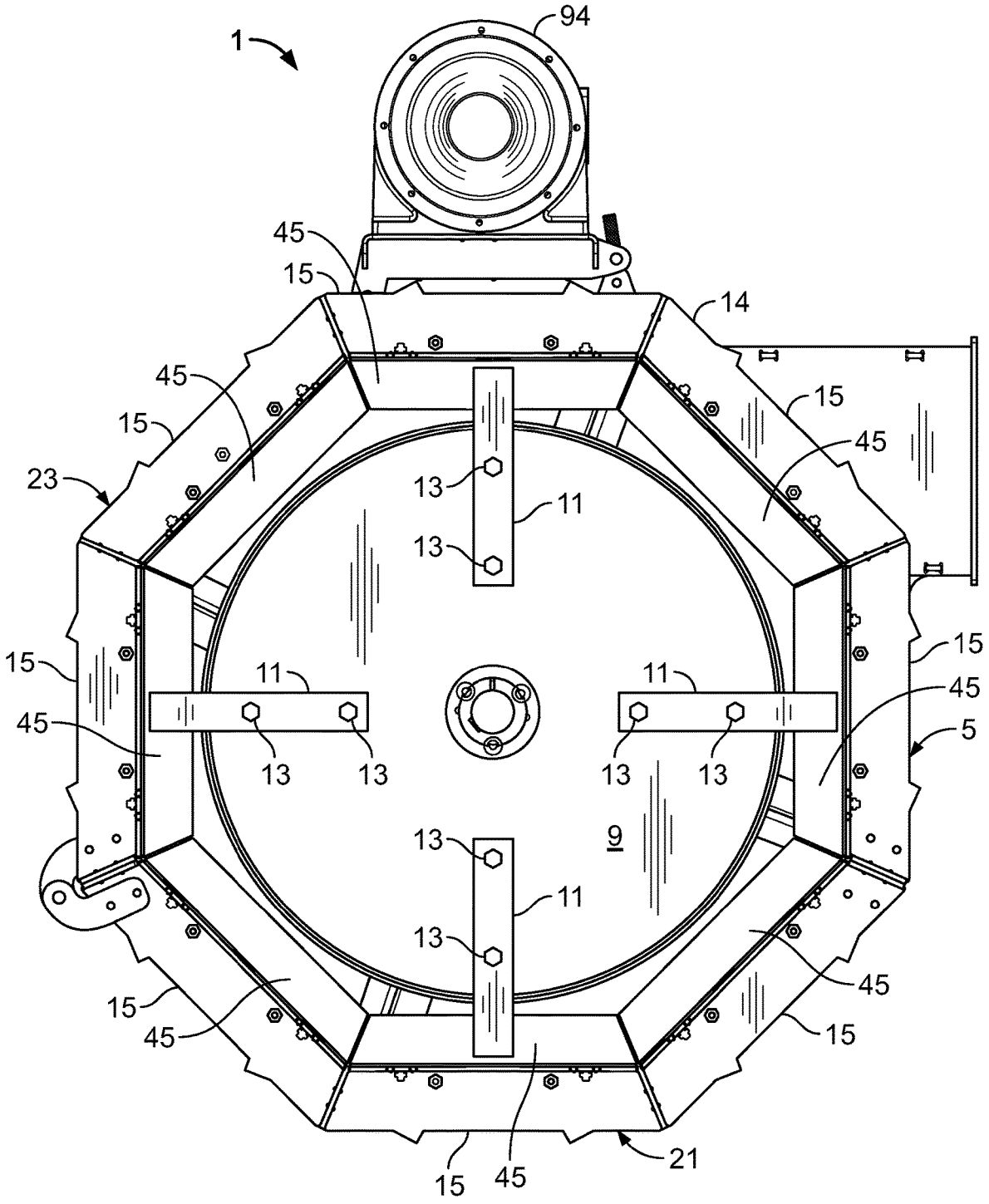
FIG. 3 is a cross sectional view of the mill taken generally along line 3-3 in FIG. 2.
Figure 4:
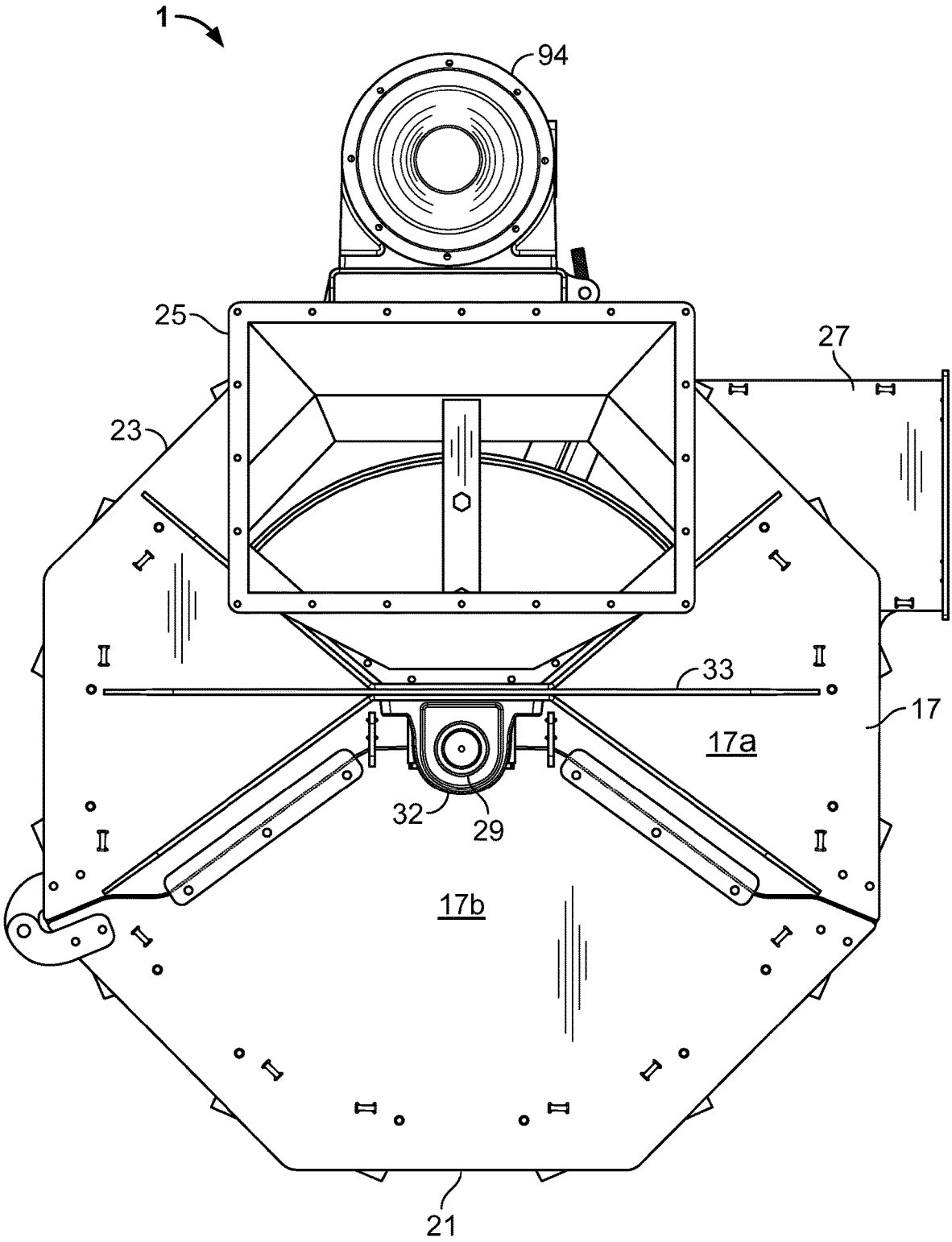
FIG. 4 is top plan view of the mill of FIG. 1.
Figure 5:
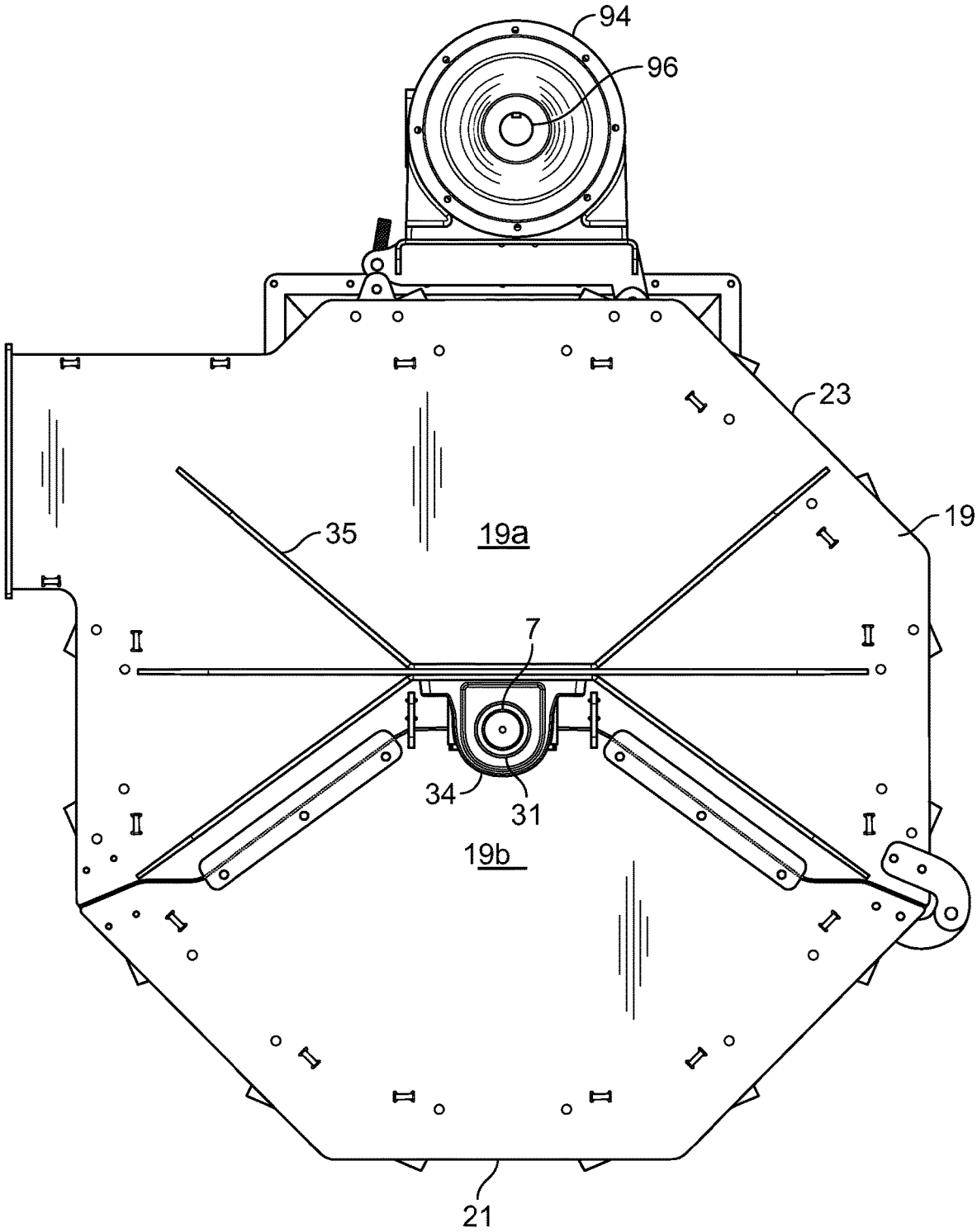
FIG. 5 is a bottom plan view of the mill of FIG. 1.
Figure 6:
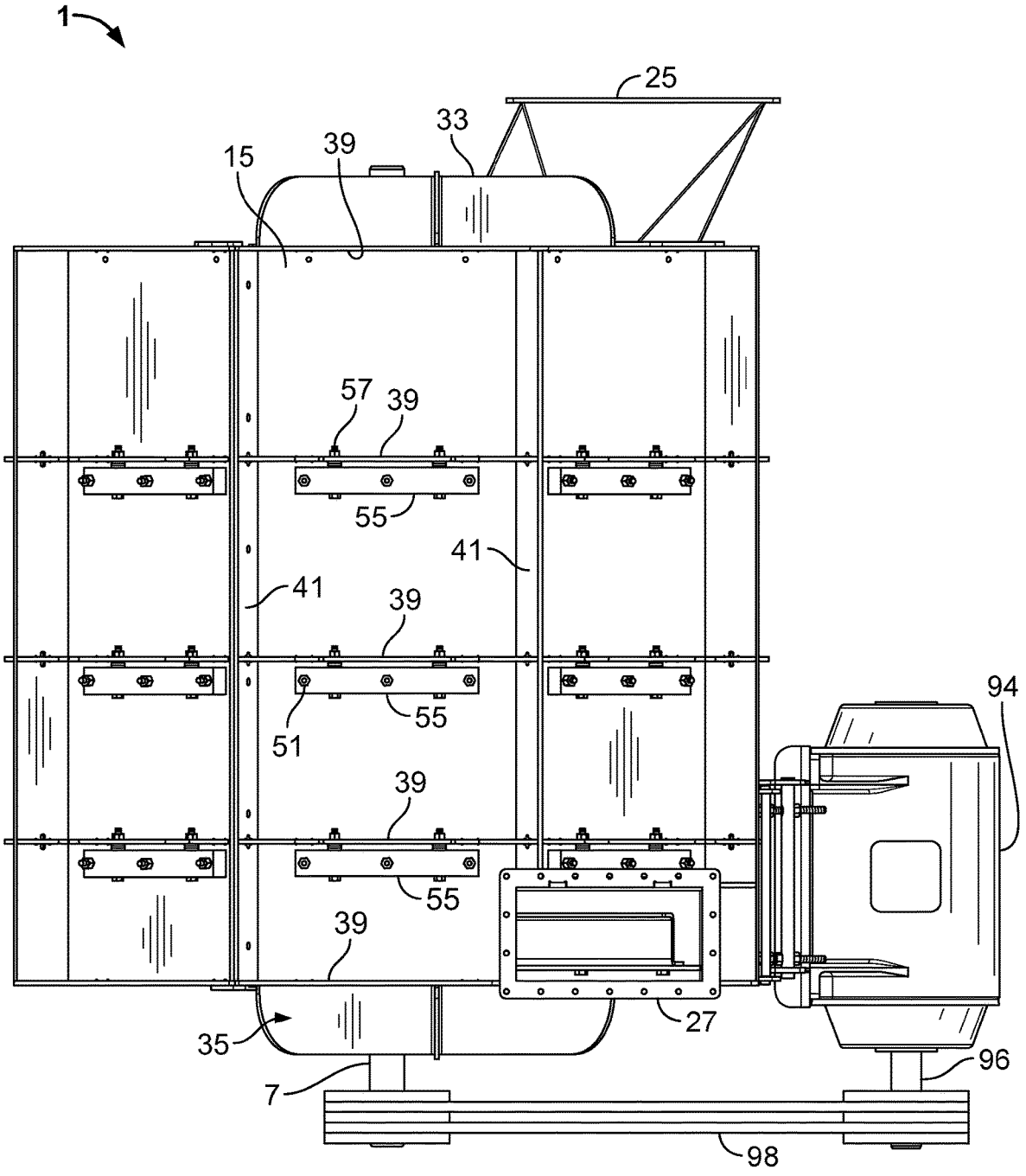
FIG. 6 is a side elevational view of the mill of FIG. 1.
Figure 7:
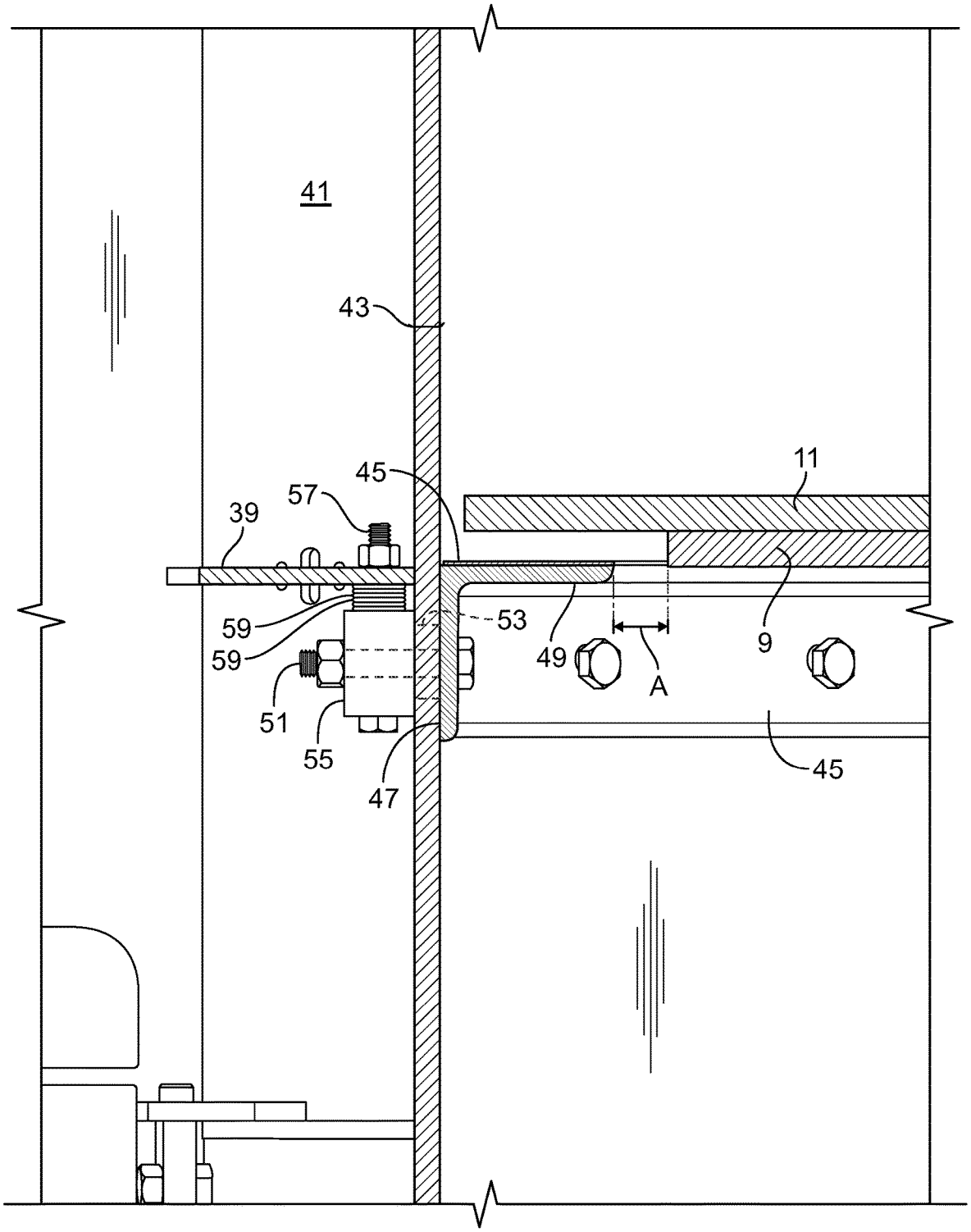
FIG. 7 is an enlarged fragmentary cross-sectional view similar to FIG. 2 showing mounting detail for angle deflectors that form a portion of the mill in accordance with an embodiment of the invention.

Each sidewall section 15 includes a sidewall framework comprising a plurality of horizontal ribs 39 extending between vertical ribs 41, as depicted in FIGS. 6 and 7. A respective replaceable wear plate 43 covers the interior of each sidewall framework. Mounted to the interior surface of each wear plate 43 are a plurality of angle deflectors 45, the number of angle deflectors 45 on each sidewall section 15 being equal in number to the number of cutter discs 9. As shown in FIG. 7, each angle deflector 45 includes a vertical flange 47 positioned in abutment against the interior surface of the respective wear plate 43 and a horizontal flange 49 that extends inwardly from the respective sidewall section 15. The angle deflectors 45 are positioned such that the horizontal flanges 49 are each in general alignment with a portion of the outer edge of a respective one of the cutter discs 9 such that the respective hammers 11 move in closely spaced relation to the upper surface of the horizontal flange 49. More preferably, the angle deflector top surface is planarly aligned with the bottom surface of the cutter disc 9. As shown in FIG. 3, the ends of the angle deflectors 45 are cut at an angle (such as approximately 67.5 degrees) such that the horizontal flanges 49 of angle deflectors 45 on adjacent sidewall sections 15 cooperate to form octagonal shelves that extend continuously around the interior of the housing 5. Alternatively, the ends of the angle deflectors 45 can be cut such that the horizontal flanges 49 of the angle deflectors 45 on adjacent sidewall sections 15 cooperate to form arcuate or rounded (concave) shelves that extend continuously around the interior of the housing. However, in one or more embodiments, one or more angle deflectors 45 may be removed from its respective sidewall section 15 to define a void between the outer edge of its respective cutter disc 9 and the particular sidewall section 15

The angle deflectors 45 are mounted to the respective sidewall sections 15 in such a manner that the position of each angle deflector 45 can be fine-tuned to insure proper alignment relative to the respective cutter disc 9. As noted, one or more angle deflectors 45 can also be removed entirely from its respective sidewall section 15. Referring again to FIG. 7, a plurality of bolts 51 (three shown in FIG. 6) extend through holes in the vertical flange 47 of each of the angle deflectors 45, through oblong or oversize openings 53 in the respective wear plate 43, and through horizontal holes in a respective adjustment block 55. The adjustment blocks 55 are each connected to the sidewall framework 37 by vertical bolts 57 that extend through aligned holes in the adjustment block 55 and in a respective one of the horizontal ribs 39 of the respective sidewall framework 37. Shims, washers or spacers 59 can be placed around the vertical bolts 57 between the adjustment block 55 and horizontal rib 39 to adjust the height of the adjustment block 55 and connected angle deflector 45 within the range of the oblong openings 53 in the respective wear plate 43.

A gap A is defined between the outer edge of each cutter disc 9 and the inner edge of the horizontal flanges 49 of the respective angle deflectors 45. In one or more embodiments, the cutter discs 9*a*, 9*b*, and 9*c* are of somewhat increasing diameter from the top to the bottom of the mill 1 such that the gap A (FIG. 7) decreases from top to bottom. The cutter discs 9*a*, 9*b*, and 9*c* may also be of decreasing diameter from the top to the bottom of the bill 1 such that the gap A (FIG. 7) increases from top to bottom.

Figure 2:
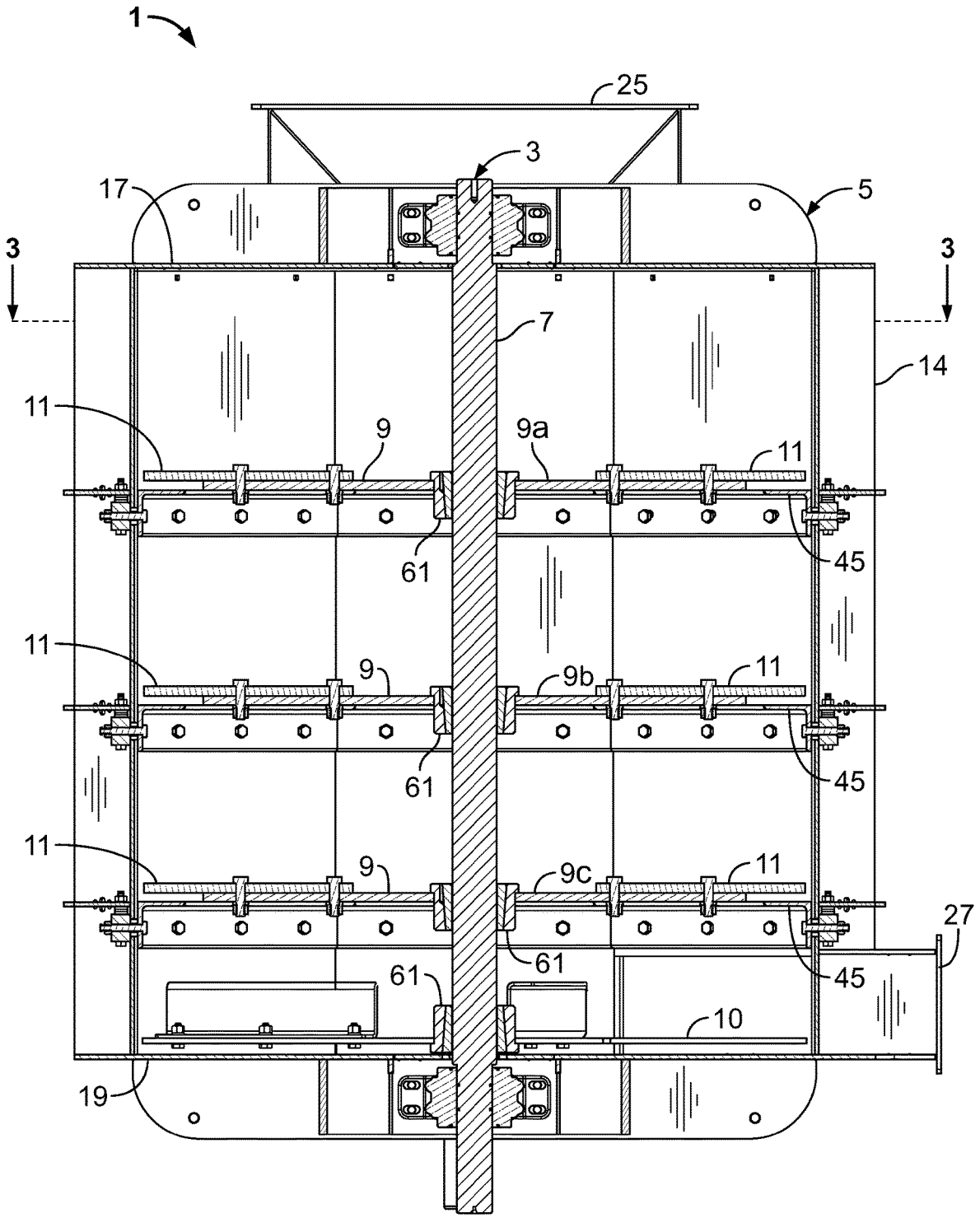
FIG. 2 is a cross sectional view of the mill taken generally along line 2-2 in FIG. 1.

Referring to FIG. 2, the positions of the cutter discs 9 and fan disc 10 along the shaft 7 are also adjustable due to the use of taper lock hubs 61 to connect the discs 9 and 10 to the shaft 7. It is understood that other forms of connections may be employed for mounting the discs 9, 10 to the shaft 7, including for example other types of machine keys, such as a stepped-head key, also known as a gib head key, which can be tapered or straight (not shown). It will be appreciated that any type of machine key system can be used to connect discs 9, 10 to the shaft 7. The key prevents relative rotation between the two parts and may enable torque transmission. For a key to function, the shaft 7 and discs 9, 10 will have a keyway and a keyseat, which is a slot and pocket in which the key fits. The whole machine key system is referred to as a keyed joint.

Figure 8:
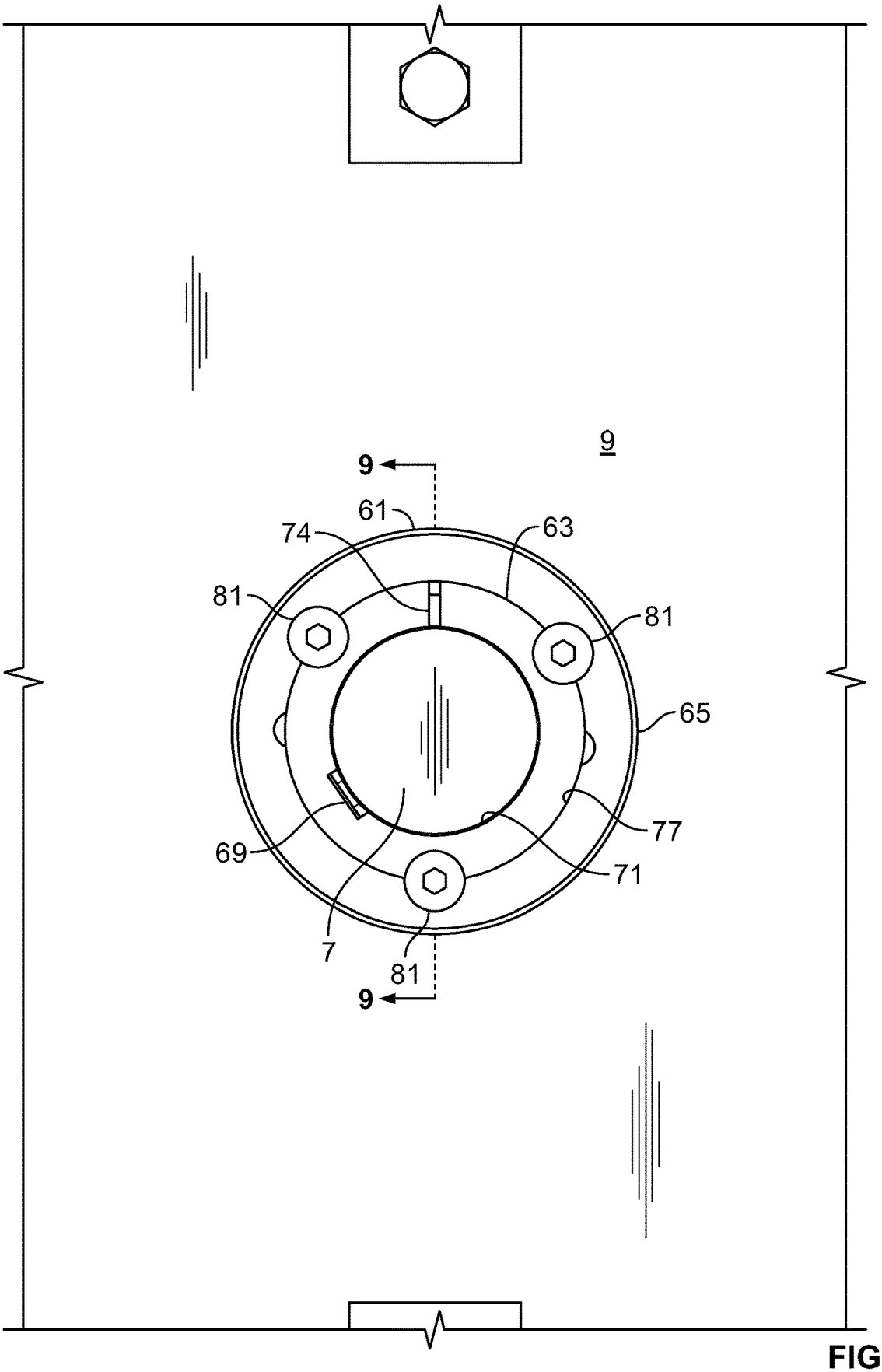
FIG. 8 is an enlarged fragmentary cross-sectional view similar to FIG. 3 showing a taper lock hub used for mounting cutter discs that form a portion of the mill in accordance with an embodiment of the invention.
Figure 9:
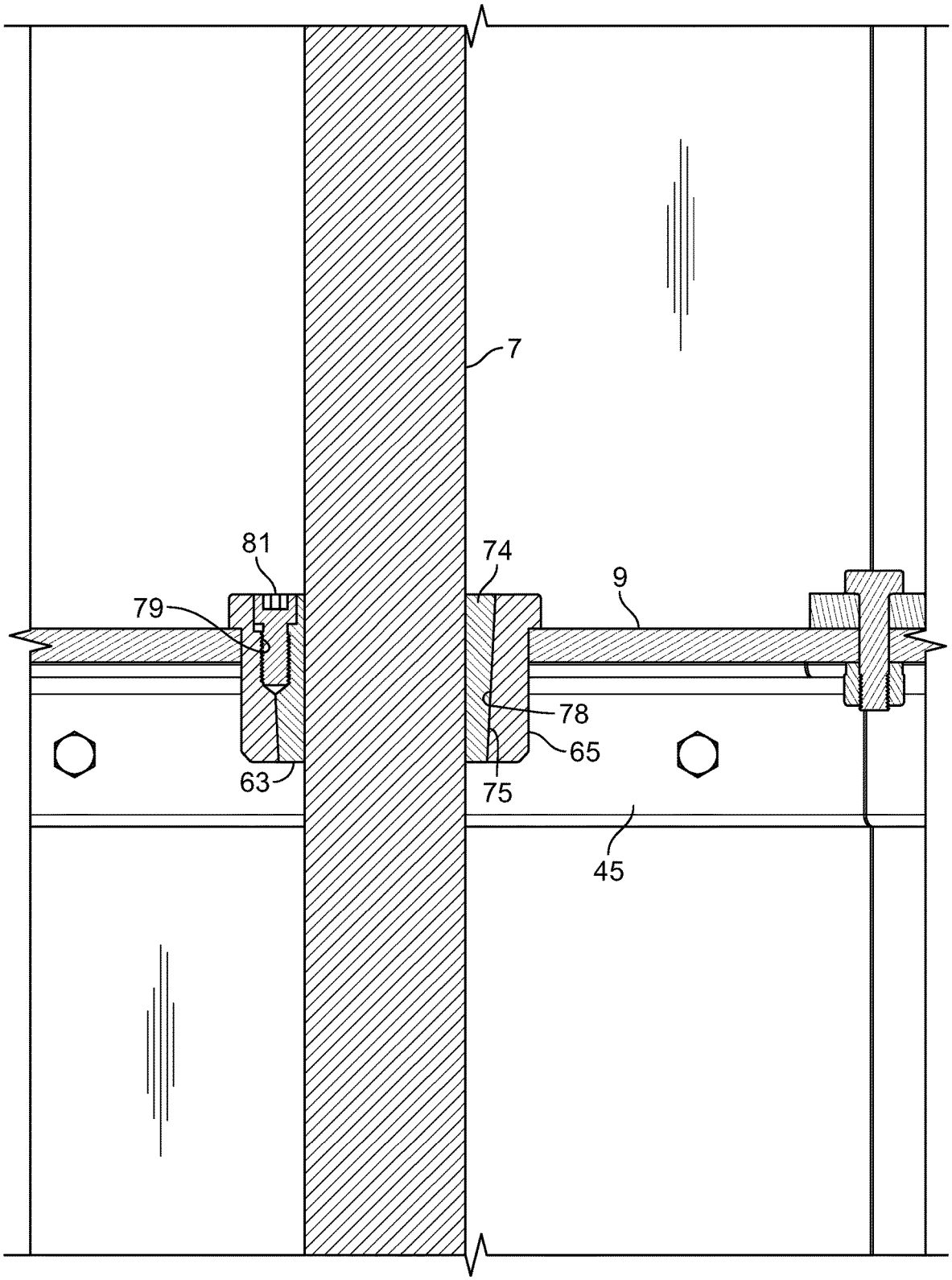
FIG. 9 is a cross-sectional view of a taper lock hub taken generally along line 9-9 in FIG. 8.

In one or more embodiments, as depicted in FIGS. 8 and 9, each hub 61 includes an inner hub member 63 and an outer hub member 65. The respective cutter disc 9 or fan disc 10 is connected to the outer hub member 65, such as by welding. The shaft 7 includes a respective keyway formed therein for each of the discs 9 and 10. Each keyway receives a key 69. The inner hub member 63 includes a shaft receiver 71 with a keyway sized to receive the key 69. The inner hub member 63 includes a split 74 that allows it to be compressed against the shaft 7 and a tapered outer surface 75. The outer hub member 65 has a central bore 77 sized to receive the inner hub member 63 and an inner surface 78 tapered to match the outer surface 75 thereof. A plurality of fastener receivers 79 are formed between the inner hub member 63 and outer hub member 65 and receive threaded fasteners 81 for drawing the inner hub member 63 into the central bore 77 of the outer hub member 65.

With the fasteners 81 loose and the inner hub member 63 uncompressed, the hub 61 (and attached cutter disc 9 or fan disc 10) can be moved along the shaft 7 and repositioned anywhere within the limits of the length of the respective key 69. Once the cutter disc 9 is in the desired position, the fasteners 79 are tightened, drawing the inner hub member 63 into the tapered central bore 77 of the outer hub member 65 and compressing the inner hub member 63 against the shaft 7 to retain the hub 61 and disc 9 or 10 in position.

Figure 10:
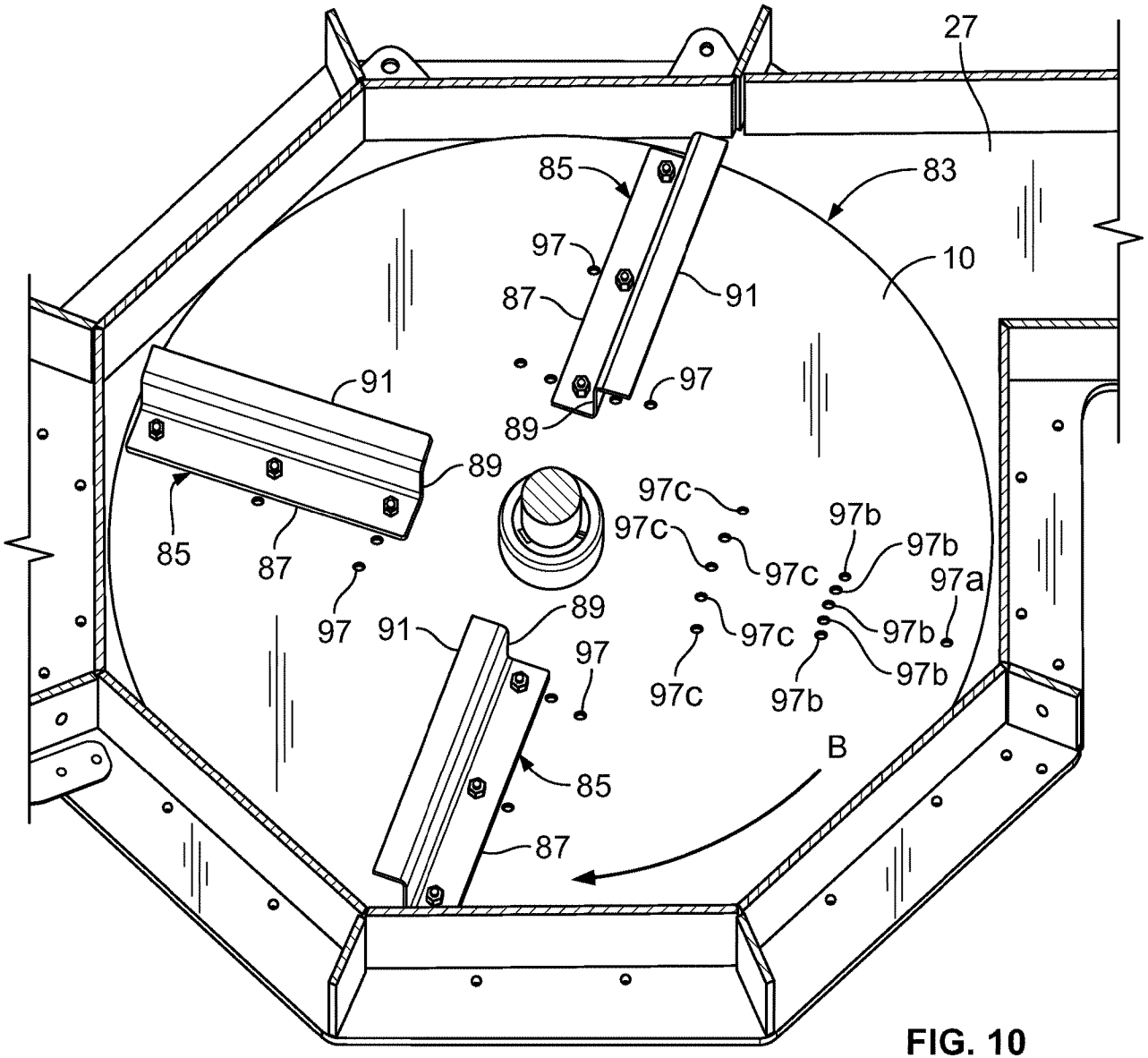
FIG. 10 is a cross-sectional perspective view taken generally along line 10-10 in FIG. 1 and showing a fan assembly (with one blade removed for clarity) that forms a portion of the mill.

Referring to FIG. 10, the fan disc 10 forms part of a fan assembly 83 which acts to provide airflow through the mill 1 and to thereby improve drying of the material, to help move material through the mill 1, and to expel the ground material through the discharge chute 27. The fan assembly 83 includes a plurality of fan blades 85 which are affixed to the upper surface of the fan disc 10 in a generally radial orientation (mounted on top of the fan disc 10). Four fan blades 85 are provided in the embodiment depicted with three of the fan blades 85 being shown in FIG. 10. The fourth fan blade 84 has been deleted to show detail that would otherwise be concealed by the deleted fan blade 85. The fan blades 85 each include a bottom flange 87 securable to the fan disc 10, and an upwardly extending web 89 (that extends away from the upper surface of the fan disc 10 and towards the cutter discs 9 above). In some embodiments, the fan blades 85 also include a top flange 91 that extends outwardly from the web 89 in the direction of rotation of the fan disc 10 (designated by arrow B). More specifically, in one embodiment of the fan blade 85, the web 89 extends generally vertically upward from the leading edge of the bottom flange 87 (in the direction of rotation B of the fan disc 10). The top flange 91 then extends generally horizontally outward from the top edge of the web 89, again in the direction of rotation of the fan disc 10. It is foreseen, however, that the angles between the bottom flange 87, web 89, and top flange 91 could be other than right angles, and/or that the top flange 91 may be omitted. It will also be appreciated that the bottom flange 87, web 89, and optional top flange 91 may be unitarily formed as a unitary (monolithic) piece. Alternatively, the bottom flange 87, web 89, and optional top flange 91 may be separate, individual pieces that have been welded or otherwise joined together. The fan blades 85 may also be of uniform thickness, but may also have reinforced sections of greater thickness, particularly in the web 89.

The bottom flange 87 of each of the fan blade 85 has a plurality of mounting holes formed therein for receiving fasteners 95 (three shown) used to connect the fan blades 85 to the fan disc 10. The fan disc 10 has mounting holes 97 formed therein for receiving the fasteners 95. It is preferred, however, that there be extra mounting holes 97 in the disc 10 to allow the blades 85 to be selectively repositioned to adjust the airflow through the mill 1. For example, the disc 10 is shown in the drawings as having a single mounting hole 97*a* proximate the outer edge of the disc 10 for the outermost of the fasteners 95. The remaining fasteners 95 are provided with multiple mounting holes 97, arranged in arcuate rows. Five mounting holes 97*b* are shown for the middle fastener 95, and five mounting holes 97*c* are shown for the innermost fastener 95. By selectively pivoting the fan blades 85 about the fastener 95 in the outermost hole 97*a* and selecting different pairs of the mounting holes 97*b* and 97*c*, an operator of the mill 1 can adjust the angular orientation of the fan blades 85 relative to a true radial orientation and thereby increase or decrease the airflow through the mill 1 to best suit specific materials to be ground and operating conditions.

It will also be appreciated that the fan blades 85 can be positioned in a number of different arrangements on the fan disc 10, other than a strictly radial arrangement, which refers to blades extending straight out from the center of the hub.

In addition, the fan blades 85 themselves may be of varied shapes. Examples which are known for centrifugal fan configurations, in addition to radial flat blades, include forward-curved blades, backward-curved blades, forward-inclined blades, and backward-inclined blades. Forward-curved blades curve in the direction of the fan disc rotation. Backward-curved blades curve against the direction of the fan disc rotation. Forward- and backward-inclined blades are straight, not curved, but extend at an angle, other than straight out from the center of the hub.

In one embodiment, an interior surface of the wear plates 43 is provided with an arcuate surface in an area adjacent to the fan assembly 83, e.g., substantially between the bottom wall 19 of the mill 1 and the lower most cutter disc 9*c*. The arcuate surface forms a generally cylindrical interior surface within the bottom of the housing 5. The cylindrical interior surface aids to reduce wear between the fan assembly 83 and the wear plates 43. The arcuate surface may be formed integrally into a surface of the wear plates 43, or insert plates (not shown) may be installed on the inner surface of the wear plates 43. The dimensions of the fan disc 10 may be at least partially reduced to provide additional space for installation of the insert plates.

The rotor 3 of the mill 1 is driven by a motor 94 which may be, for example, an electric or hydraulic motor. The motor 94 can be mounted to the mill 1 in any suitable configuration using any suitable attachment elements. In one or more embodiments, the motor 94 is mounted to one of the sidewall sections 15 and includes a shaft 96 which is operably connected to a lower portion of the shaft 7 that extends below the bottom wall 19 of the housing 5, such as by a chain and sprocket or belt and sheave system, or hydraulic drive system 98.

In one or more embodiments, the fan disc 10 rotates independently of the cutter discs 9. In one or more embodiments, one or more of the plurality of cutter discs 9*a*, 9*b* and 9*c* rotates independently of the others. Various technologies are known in the art for applying an independent rotational force to the cutter discs 9 and/or the fan disc 10. For example, differential rotation speeds may be achieved by separate drive systems for each rotating element, or by any type of mechanical transmission arrangement between any of the various rotating elements. In one or more embodiments, shaft 7 can comprise dual rotors which are coaxially disposed as an inner rotor and an outer rotor which houses the inner rotor (not shown). That is, a first rotational force can be applied to the first inner rotor and a second rotational force can be independently applied to a second outer rotor. In one or more embodiments, the fan disc 10 is connected to a second, separate rotor and corresponding shaft (not shown) that is spaced below, and longitudinally aligned with shaft 7. As such, the rotor 3 of the mill 1 is driven independently of the second rotor, which drives the fan disc 10. It will be appreciated that having rotating elements of the mill 1 driven independently provides a finer degree of control over the air flow velocity and pressure inside the mill 1.

The mill 1 may be mounted on any suitable supporting structure, including the ground, a raised platform, or even a trailer (not shown) if it is desired to make the mill 1 portable. Suitable conveyors may be provided for moving material into the inlet 25 and away from the outlet 27. In one or more embodiments, an industrial damper (not shown) can be included immediately after the outlet 27 to allow volumetric flow control during operation. It is envisioned now as a multi-blade shutter-type damper. The damper blades will be made from, or at least covered with, a hardened abrasion-resistant surface. In practical terms, replaceable wear bars may be preferable to replacing the entire blade. The damper will be used to modulate the discharge velocity as well as the air pressure inside the mill.

Figure 11:
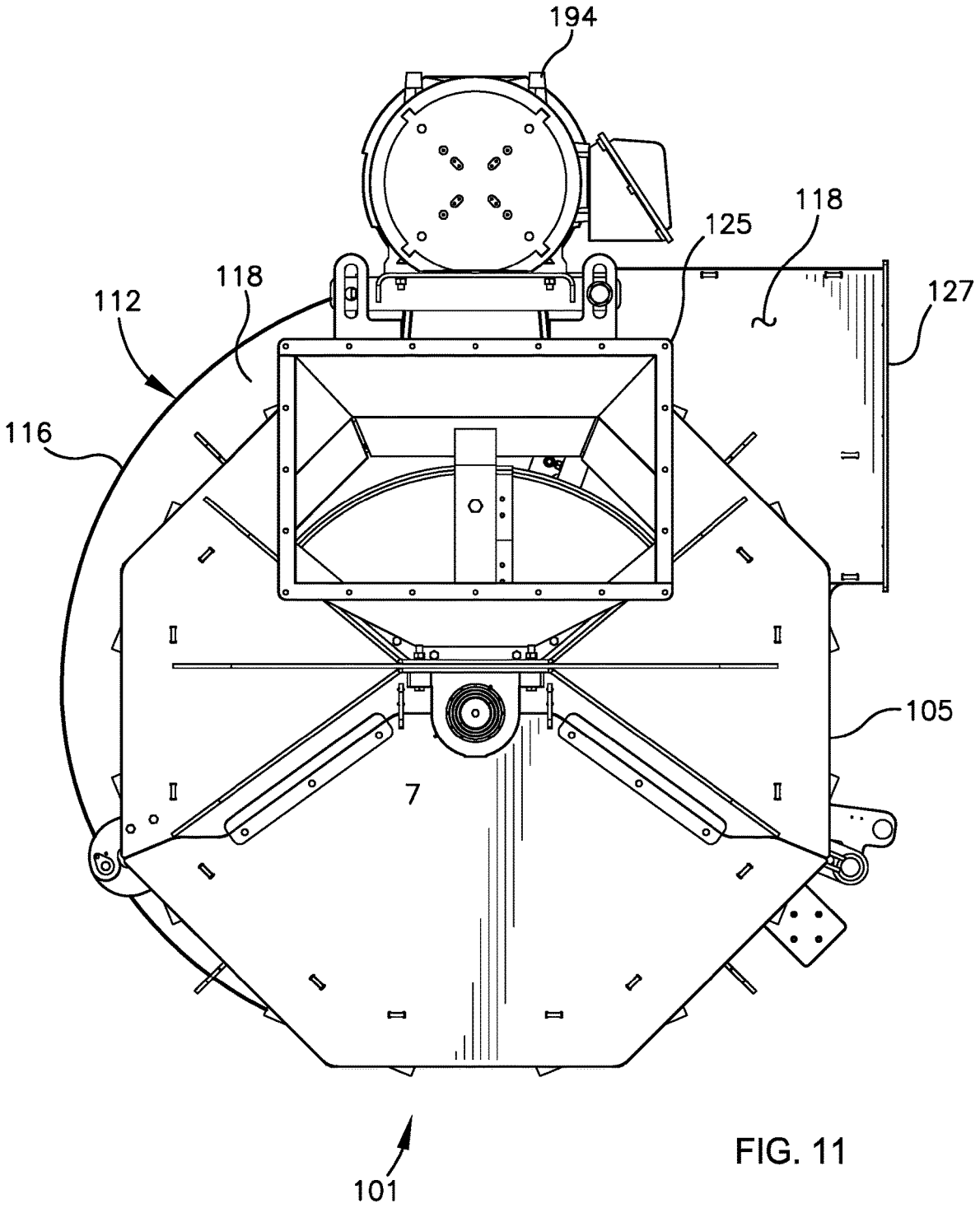
FIG. 11 is a top plan view of a mill with a nautiloid-style fan housing depicted in accordance with another embodiment of the invention.
Figure 12:
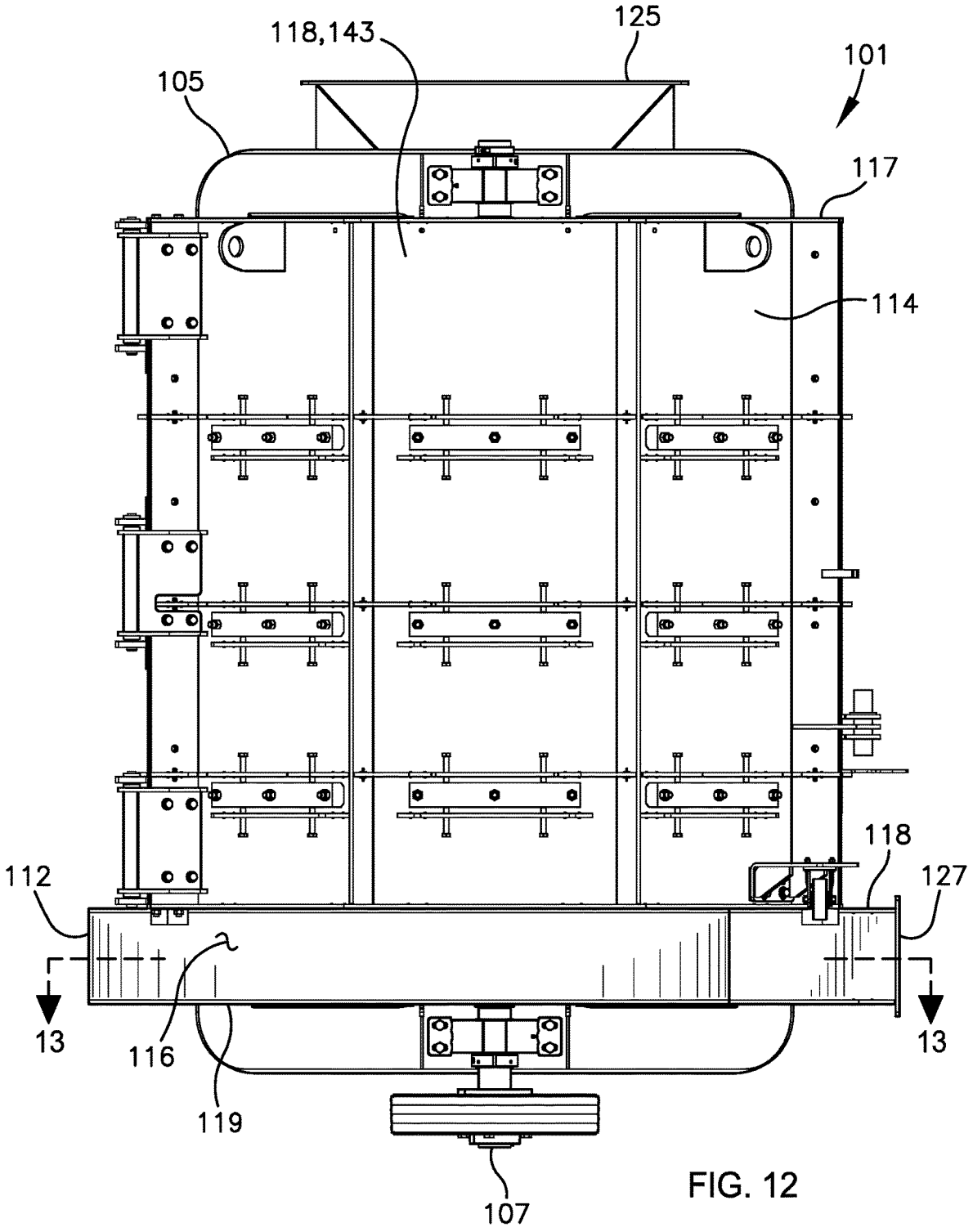
FIG. 12 is a side elevational view of the mill of FIG. 11.
Figure 13:
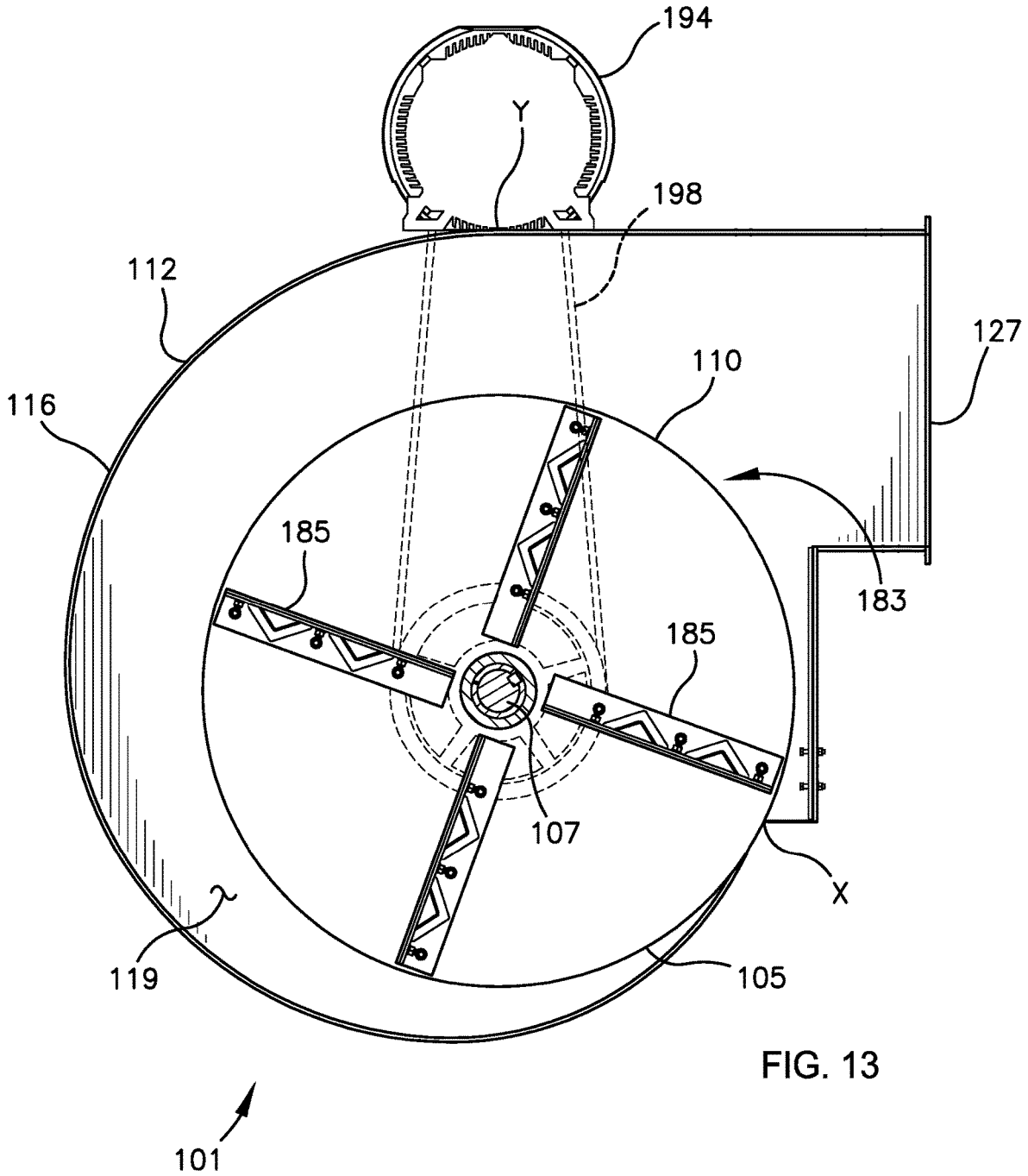
FIG. 13 is a cross-sectional view taken along the line 13-13 in FIG. 12.

With reference now to FIGS. 11-13, a mill 101 is described in accordance with an embodiment of the invention. Embodiments of the mill 101 described herein may include many features similar to those described with respect to the mill 1 described above. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

The mill 101 includes a terminal portion or fan housing 112 nearest the bottom wall 119 with a gradually, radially expanding outer wall 116. The fan housing 112 may extend from the bottom wall 119 toward the top wall 117 a desired distance but preferably extends less than about half the distance between the bottom wall 119 and lower most cutter disc 109 (not shown). The height of the fan housing 112 may be substantially equal to the height of the discharge chute 127. The fan assembly 183 and fan disc 110 are disposed within the fan housing 112 adjacent the bottom wall 119 in a manner similar to that described with respect to the mill 1. In one or more embodiments, the fan housing 112 may be positioned inside the plurality of sidewall sections 115 of the mill main housing (not shown). In one or more embodiments, the fan housing 112 is an extension of the mill housing, as illustrated in the drawings. As such, the bottom wall 119 is shaped and dimensioned to follow the contour of the outer wall 116 to fully enclose the bottom end of the mill 101. In this embodiment, a top plate 118 extends over the fan housing 112 and between the exterior of the mill 101, e.g., to connect the sidewall sections 115 and the outer wall 116 of the fan housing 112 and thereby enclose the grinding chamber of the mill 101, so that it is in open communication with the discharge chute 127 of the fan assembly 112. The mill 101 may otherwise be configured and operate like the mill 1 described above. Regardless, the fan assembly and housing 112 is integrally configured as part of the mill housing to define a unitary chamber within the mill 101.

The outer wall 116 of the fan housing 112 expands radially outwardly in an arcuate path delimiting the circumference of the fan housing 112, and defining a radially expanding flowpath for material exiting the discharge chute 127. As depicted in FIG. 13, the outer wall 116 begins at a radial distance as measured from the center point of the fan disc (e.g., at the shaft 107) that is substantially equal to or just greater than the radial dimension of the fan disc 110 (as measured from the center point of the disc 110 to the outer edge 105 of the fan disc 110) at a point X. The radial distance between the outer wall 116 and the center point of the disc 110 gradually increases along the curved passageway about the circumference of the fan housing 112 to a point Y from which the outer wall 116 follows a substantially tangential path to the discharge chute 127. The radial expansion of the outer wall 116 follows the rotational direction of the shaft 107, e.g. the radial dimensions increase in the direction of the shaft rotation, such than the fan housing 112 has an increasing radius of curvature as measured from the center of the fan disc (e.g., the shaft 107), in the direction of rotation, towards the discharge chute 127. As such, the distance between the outer edge 105 of the fan disc 110 and the outer wall 116 gradually increases to define a space therebetween along the arcuate path from point X to point Y, where the space between the outer edge 105 of the fan disc 110 and outer wall 116 at point Y is greater than the space between the outer edge 105 of the fan disc 110 and the outer wall 116 at point X (and preferably substantially greater). As such, the fan assembly 183 and shaft 107 are preferably offset from the center of the fan housing 112, as illustrated in the drawing.

In this manner, the fan housing 112 defines a radially-expanding curved or arcuate flowpath for air and material towards the discharge chute 127. In one embodiment, the inner surface of the outer wall 116 preferably delimits a continuous or smooth arcuate or curvilinear path from point X, resembling a scroll, spiral, volute or nautiloid-type form. However, it will be appreciated that the outer wall 116 may be configured to instead delimit a polygonal or faceted path formed by a plurality of linear sections, giving rise to an otherwise generally spiral or nautiloid-shaped flowpath. In another embodiment, the interior surface of the wear plates 43 adjacent to the fan assembly 183 and/or a secondary internal wall (not shown) are configured to form the outer wall 116 and to provide a volute or nautiloid shape that lies within the interior of the housing 5.

The configuration of the fan housing 112 with a volute or nautiloid configuration increases the efficiency of the mill 101 in discharging ground materials and in generating airflow therethrough. In one or more embodiments, in operation of the machine, about 10,000 cubic feet per minute (CFM) of air flow through the mill will remove about 1 ton of moisture per hour from the material being processed through the mill. In one or more embodiments, processing the material through the mill reduces the moisture content of the processed material. The % of moisture content reduction is calculated as:

$$\frac{\left(\left(\begin{array}{c}\text{Initial mass of starting material}\\ \text{fed into inlet}\end{array}\right)-\left(\begin{array}{c}\text{Final mass of processed material}\\ \text{collected from discharge chute}\end{array}\right)\right)}{\text{Initial mass of starting material fed into inlet}}$$

In one or more embodiments, processing material through the mill reduces the moisture content in the mill by at least about 25%, and preferably at least about 50% (subject to relative humidity considerations). In some embodiments, the amount of water removed is subject to the starting moisture content of the initial materials (with more water being removed from a wetter starting material). There is a diminishing rate of drying as the initial moisture content is lower. The configuration also decreases the wear encountered by the interior surface of the outer wall 116 and/or the wear plates 143 of the sidewall sections 115. As described previously, mill configurations in which the inner walls of the mill near the discharge chute are faceted have been found to wear excessively. The ground materials tend to follow along each wear plate in a generally linear (parallel) fashion and then contact the next adjacent wear plate in a somewhat head-on (perpendicular) and forceful fashion at or near the junction between the wear plates due to their differences in orientation. The impact of the ground materials against the adjacent wear plate erodes the wear plate and eventually leads to need for replacement thereof.

By providing a curvilinear, smooth flowpath or passageway for the ground materials to follow, the wearing of the outer wall 116 is greatly decreased while the discharge efficiency and the airflow that can be generated through the mill 101 is increased due to the more freely flowing of the ground materials. Further, by increasing the radial dimensions of the outer wall 116 the ground materials may be at least partially slowed along their discharge path which further reduces the erosive force of the ground materials on the outer wall 116. The increased dimensions of the outer wall 116 further reduce wear on the outer wall 116 by eliminating pinching and grinding of the ground materials between the outer wall 116 and the edges 105 of the fan assembly 183 as the fan assembly 183 rotates relative to the outer wall 116.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

The invention claimed is:

1. A mill for grinding material, said mill comprising:
- a housing comprising a top wall and an inlet for admitting material into the mill, said housing comprising a bottom wall and a plurality of sidewall sections extending between said top wall and said bottom wall;
- a vertical, rotatable shaft having at least one cutter disc driven thereby, said at least one cutter disc being mounted inside said housing; and
- a fan assembly integrally mounted inside said housing and spaced below the at least one cutter disc and adjacent said bottom wall, said fan assembly comprising:
  - a fan disc having an outer edge, a direction of rotation, and a plurality of fan blades mounted on top of the fan disc, each fan blade comprising an upwardly extending web; and
  - a fan housing comprising a radially expanding outer wall and a discharge outlet for discharging material from the mill, wherein said outer wall follows an increasing radius of curvature as measured from the center of said fan disc in the direction of rotation towards the discharge outlet, and defines a radially expanding, spiral-shaped flowpath as measured between the outer edge of said fan disc and said outer wall, said flowpath configured for conducting material to said discharge outlet.

2. The mill of claim 1, wherein said bottom wall is shaped and dimensioned to follow the contour of the outer wall to fully enclose the bottom portion of the mill except for said discharge outlet.

3. The mill of claim 1, wherein said fan disc is mounted on the shaft and rotatable therewith.

4. The mill of claim 1, wherein said fan disc rotates independently of the at least one cutter disc.

5. The mill of claim 1, comprising a plurality of said cutter discs, wherein each of said cutter discs rotates independent of the other cutter discs.

6. The mill of claim 1, wherein said outer wall is configured to delimit a smooth arcuate flowpath towards said discharge outlet.

7. The mill of claim 1, wherein said outer wall is configured to delimit faceted flowpath formed by a plurality of segmented linear sections towards said discharge outlet.

8. The mill of claim 1, said housing comprising a bottom wall and a plurality of sidewall sections said mill further comprising:

a plurality of hammers mounted on the at least one cutter disc and extending outwardly past an outer edge of the at least one cutter disc;

angle deflectors mounted on respective sidewall sections, the angle deflectors extending inwardly from the sidewall section and having an edge in general alignment with the outer edge of the at least one cutter disc and defining a gap therebetween, the hammers each rotating in closely spaced relation to a top surface of the angle deflectors.

9. The mill of claim 8, said housing comprising a door, wherein said top wall and bottom wall are each divided into respective first sections and second sections, said first sections forming part of a main housing, and said second sections forming part of the door, wherein a line of division between the first sections and the second sections extends through an axis of rotation of the shaft.

10. The mill of claim 9, said door being hingedly connected to said main housing.

11. The mill of claim 9, wherein the housing comprises eight sidewall sections, wherein the door comprises three of the sidewall sections, and the main housing comprises five of the sidewall sections.

12. A method of grinding material from an initial size and moisture content to a reduced particle size and moisture content, said method comprising:

providing a mill according to claim 1;

introducing a material having an initial size and moisture content into the inlet of said mill;

processing said material in said mill by rotating said at least one cutter disc and said fan disc, whereby said material is reduced from said initial size to a reduced particle size and whereby said initial moisture content is reduced in said material after said processing; and collecting said material of a reduced particle size and reduced moisture content from said discharge outlet.

13. The method of claim 12, wherein said material comprises rigid and non-rigid components, said processing step separating said rigid components from said non-rigid components and reducing the size of said rigid and non-rigid components.

14. The method of claim 12, wherein said material has an initial moisture content prior to said processing, wherein the moisture content of said material after said processing is reduced by at least 25%.

15. The method of claim 12, wherein said fan assembly draws air into said inlet of said mill and expels air and said material of reduced particle size out of said discharge outlet during said rotating.

16. The method of claim 15, wherein about 10,000 cubic feet per minute of air flow through said mill will remove about 1 ton of moisture per hour from said material during said processing.

17. The method of claim 12, wherein said material is selected from the group consisting of carpet, tires, shoes, hydraulic hose, gypsum board, asphalt shingles, plastics, composite boards, brake pads, tires, paper goods, aluminum, textiles, biomass, agricultural waste, industrial manufactured scrap, municipal solid waste, construction waste, military waste, landfill waste, electronics, recyclables, and mixtures thereof.

18. The method of claim 12, wherein said outer wall has decreased wear from said material and increases efficiency of discharge of said material and air towards said discharge outlet.

* * * * *